US012460879B2

(12) United States Patent
Belzowski et al.

(10) Patent No.: US 12,460,879 B2
(45) Date of Patent: Nov. 4, 2025

(54) HEAT EXCHANGER

(71) Applicant: Valeo Autosystemy Sp. z o.o., Skawina (PL)

(72) Inventors: Michal Belzowski, Skawina (PL); Dawid Szostek, Skawina (PL); Milosz Augustyn, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 214 days.

(21) Appl. No.: 18/257,512

(22) PCT Filed: Dec. 8, 2021

(86) PCT No.: PCT/EP2021/084691
§ 371 (c)(1),
(2) Date: Jun. 14, 2023

(87) PCT Pub. No.: WO2022/128655
PCT Pub. Date: Jun. 23, 2022

(65) Prior Publication Data

US 2024/0035756 A1 Feb. 1, 2024

(30) Foreign Application Priority Data

Dec. 15, 2020 (EP) ..... 20461595

(51) Int. Cl.
*F28F 9/02* (2006.01)
*F28D 7/16* (2006.01)

(52) U.S. Cl.
CPC ..... *F28F 9/0229* (2013.01); *F28D 7/16* (2013.01)

(58) Field of Classification Search
CPC ..... F28F 9/0229; F28F 9/0278
See application file for complete search history.

(56) References Cited

U.S. PATENT DOCUMENTS 5,203,407 A 4/1993 Nagasaka
6,199,401 B1 3/2001 Haussmann
2007/0012432 A1* 1/2007 Hampel ..... F28D 1/05375 165/174

FOREIGN PATENT DOCUMENTS

CN 102914100 A 2/2013
CN 202885364 U 4/2013
(Continued)

OTHER PUBLICATIONS

European Patent Office, International Search Report and Written Opinion of corresponding International Application No. PCT/EP2021/084691, dated Feb. 16, 2022.

*Primary Examiner* — Eric S Ruppert
(74) *Attorney, Agent, or Firm* — Osha Bergman Watanabe & Burton LLP

(57) ABSTRACT

A heat exchanger including: a first manifold including an inlet for a heat exchange fluid, at least one first channel and at least one second channel; a second manifold spaced apart from the first manifold; and a plurality of heat exchange tubes fluidically connecting the first manifold and the second manifold. The plurality of heat exchange tubes is divided into a first section of tubes and a second section of tubes. The at least one first channel is directly connected to the inlet and a first set of tubes amongst the first section of tubes, while the at least one second channel is directly connected to the inlet and a second set of tubes amongst the first section of tubes. The first manifold is adapted to prevent the fluid from travelling between the at least one first channel and the at least one second channel within the first manifold.

6 Claims, 6 Drawing Sheets

(56) References Cited

FOREIGN PATENT DOCUMENTS

| | | | | | |
|---|---|---|---|---|---|
| DE | 19515527 | A1 | | 10/1996 | |
| EP | 2372283 | A1 | * | 10/2011 | ..... F28D 1/05391 |
| WO | 2009048451 | A1 | | 4/2009 | |

* cited by examiner

HEAT EXCHANGER

TECHNICAL FIELD

The present invention relates to the field of heat exchangers, in particular to a heat exchanger having multi-channels manifold for improving homogenous distribution of refrigerant in a core of the heat exchanger.

BACKGROUND OF THE INVENTION

Generally, heat exchangers are used in many applications to exchange heat between two or more fluids. The fluid circuits can be adapted for a refrigerant and a coolant, respectively. The refrigerant flow path can defined through the heat exchange elements provided in the heat exchanger. Generally, U-flow or two pass heat exchangers are preferred because heat exchange fluid i.e., the refrigerant, takes more time to flow across heat exchange tubes. As a result, the rate of heat exchange and thermal efficiency of the heat exchanger are increased. Although the rate of heat exchange and thermal efficiency are increased in two pass type heat exchangers, the heat exchangers experience some problems, such as non-uniform distribution of the heat exchange fluid across the heat exchange tubes. Particularly, the flow of heat exchange fluid in a first pass of the heat exchange tubes is non-uniform due to density difference in the heat exchange fluid. Such non-uniform distribution of the heat exchange fluid, the thermal efficiency of the heat exchanger is reduced and the heat exchange tubes can experience thermal shock at some heat exchange tubes.

To overcome such problems, the first pass of heat exchange tubes is further divided into two passes. Consequently, the heat exchange fluid flows uniformly across the first pass of the heat exchanger. As the first pass of heat exchange tubes is further divided into two passes, the pressure drop in the heat exchange fluid is increased. Due to this fact, the heat exchange fluid needs to be supplied at a higher pressure at an inlet of the heat exchanger, and a high power pump/compressor is required to achieve the uniform distribution of the heat exchange fluid across the heat exchange tubes, that can increase cost and size of the system. Further, non-uniform distribution of the heat exchange fluid across the heat exchange tubes of the heat exchanger reduces thermal efficiency and leads to thermal shock in some of the heat exchange tubes. As a result, service life of the heat exchange is reduced.

Accordingly, there is a need for an improved heat exchanger that promotes uniform flow of heat exchange fluid without increasing the pressure drop in the heat exchange fluid. Further, there is another need for a heat exchanger that enables uniform distribution of the heat exchange fluid in the heat exchange tubes without affecting cost and size of the heat exchanger.

In the present description, some elements or parameters can be indexed, such as a first element and a second element. In this case, unless stated otherwise, this indexation is only meant to differentiate and name elements which are similar but not identical. No idea of priority should be inferred from such indexation, as these terms can be switched without betraying the invention. Additionally, this indexation does not imply any order in mounting or use of the elements of the invention.

SUMMARY OF THE INVENTION

In view of the foregoing, an embodiment of the present invention herein provides a heat exchanger for a heat exchange fluid. The heat exchanger includes a first manifold having an inlet, being connected to the first manifold, at least one first channel and at least one second channel, and a second manifold spaced apart from the first manifold. The heat exchanger further comprises a plurality of heat exchange tubes fluidically connecting the first manifold and the second manifold. Further, the plurality of heat exchange tubes is divided into a first section of tubes and a second section of tubes. The first channel is directly connected to the inlet and a first set of tubes amongst the first section of tubes, while the second channel is directly connected to the inlet and a second set of tubes amongst the first section of tubes. Further, the first manifold is adapted to prevent the heat exchange fluid from travelling between the first channel and the second channel within the first manifold.

Further, the heat exchanger includes an outlet coupled to the first manifold. Further, the first section of tubes and the second section of tubes are arranged in at least two parallel stacks to provide at least one U-turn for the heat exchange fluid. Further, the first section of tubes fluidically connects with the second section of tubes through the second manifold According to one aspect of the present invention, the first manifold includes a third channel directed connected to the outlet and a third set of tubes amongst the second section of tubes and a fourth channel directly connected to the outlet and a fourth set of tubes amongst the second section of tubes.

In one embodiment, the second manifold includes a partition. Further, the first set of tubes fluidically connects with the third set of tubes through the second manifold and the second set of tubes fluidically connects with the fourth set of tubes through the partition of the second manifold.

According to one aspect of the present invention, the heat exchanger further includes a connector block having the inlet formed on a first side of the connector block, wherein the inlet divides into a first passage and a second passage at a second side of the connector block. Further, the first passage and the second passage are parallel with respect to each other.

In one embodiment, the first passage and the second passage of the connector block fluidically connect with the first channel and the second channel of the first manifold respectively.

According to one aspect of the present invention, the connector block further comprises the outlet formed on the first side of the connector block, wherein the outlet divides into a third passage and a fourth passage at the second side of the connector block. Further, the third passage and the fourth passage are parallel with respect to each other.

In one embodiment, the third passage and the fourth passage of the connector block fluidically connect with the third channel and the fourth channel of the first manifold respectively.

BRIEF DESCRIPTION OF DRAWINGS

The other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein.

DETAILED DESCRIPTION OF THE INVENTION

It must be noted that the figures disclose the invention in a detailed enough way to be implemented, the figures helping to better define the invention if needs be. The invention should however not be limited to the embodiment disclosed in the description.

The present invention relates to a heat exchanger, particularly to heat exchanger manifolds. In a U-flow or two-pass heat exchanger, the flow of heat exchange fluid in a first pass of heat exchange tubes is not uniform due to density difference in the heat exchange fluid. To promote uniform flow of heat exchange fluid, the first pass of heat exchange tubes is further divided into two sets of heat exchange tubes and a heat exchanger manifold is provided with two channels. The two channels are connected with the two sets of heat exchange tubes respectively and are adapted to supply the heat exchange fluid to the two sets of heat exchange tubes simultaneously. Therefore, the heat exchange fluid uniformly flows through the two sets of heat exchange tubes, without increasing the pressure drop.

Figure 1:
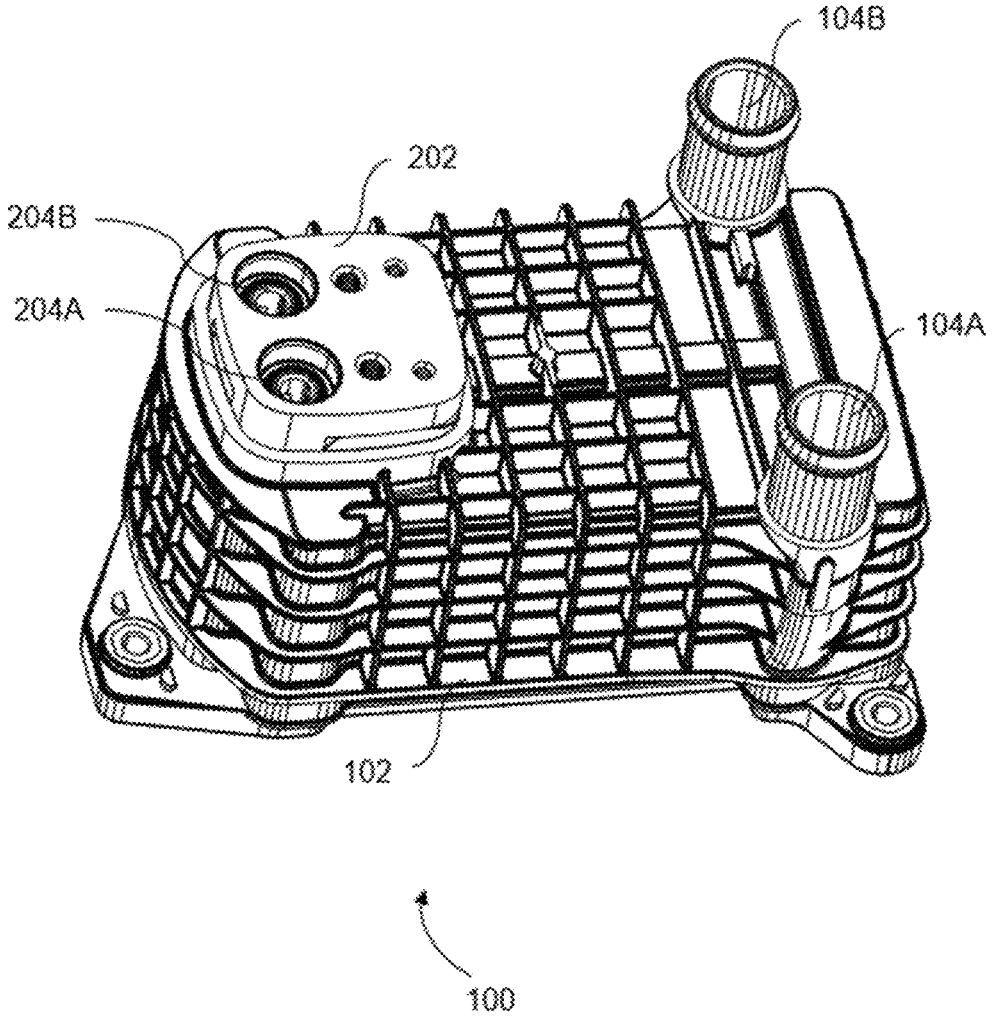
FIG. 1 illustrates a perspective view of a heat exchanger according to a preferred embodiment of the present invention.

FIG. 1 illustrates a perspective view of a heat exchanger 100 according to a preferred embodiment of the present invention. The heat exchanger 100 comprises a housing 102 within which a first heat exchange fluid circulates. The housing 102 includes a first inlet and outlet 104A, 104B adapted to connect with a first external fluid circuit supplying the first heat exchange fluid. The heat exchanger 100 further comprises a connector block 202 that includes a second inlet and outlet 204A, 204B adapted to connect with a second external fluid circuit supplying a second heat exchange fluid. In one embodiment, the first heat exchange fluid is a coolant and the second heat exchange fluid is a refrigerant.

Figure 2:
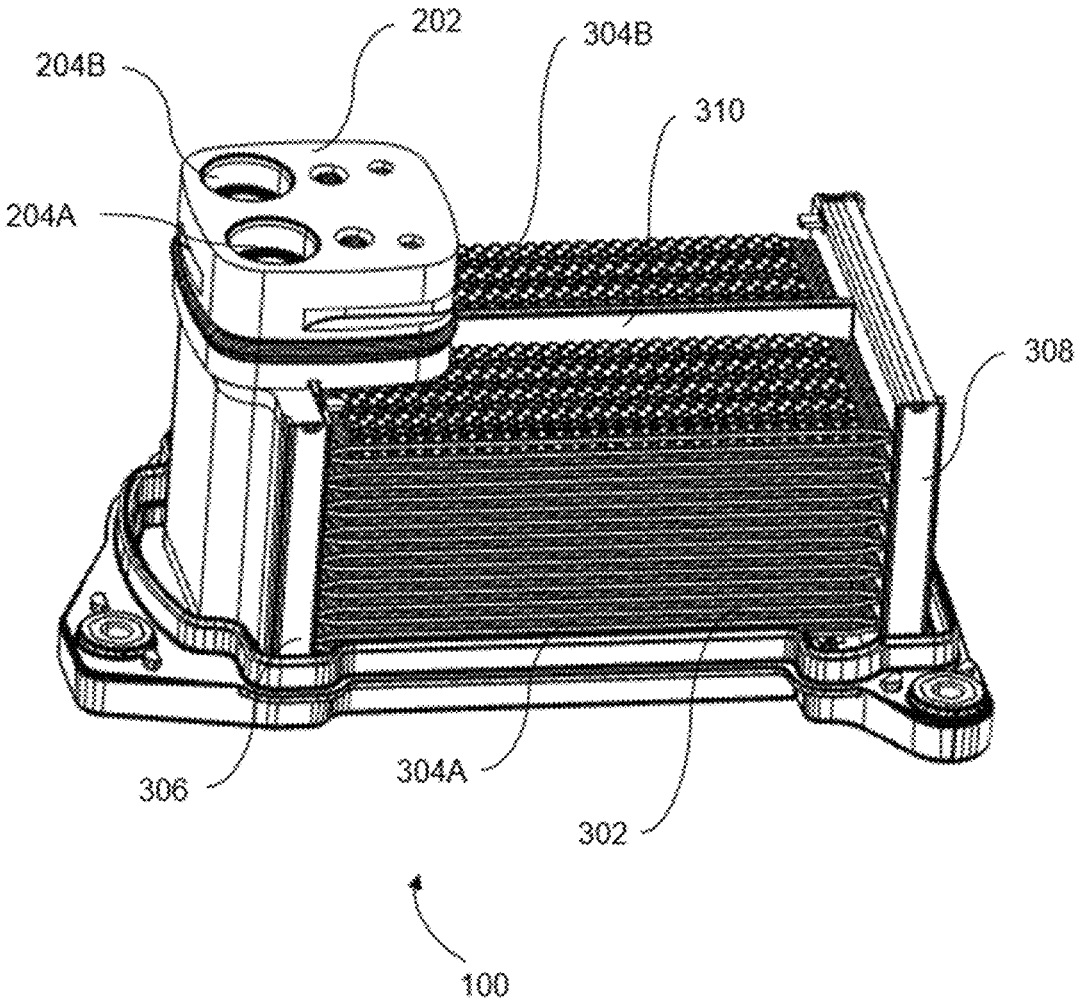
FIG. 2 illustrates a perspective view of the heat exchanger of FIG. 1 without a housing.

FIG. 2 illustrates a perspective view of the heat exchanger 100 of FIG. 1 without the housing 102. The heat exchanger 100 comprises a heat exchange core 302 through which the refrigerant circulates. The heat exchange core 302 includes a first manifold 306, a second manifold 308, and a plurality of heat exchange tubes 304 extending between the first manifold 306 and the second manifold 308. In this embodiment, the heat exchange core 302 is U-flow or two pass flow type, which includes a first section of heat exchange tubes 304A and a second section of heat exchange tubes 304B. The first section of heat exchange tubes 304A circulates the refrigerant from the first manifold 306 to the second manifold 308, and the second section of heat exchange tubes 304B circulates the refrigerant back from the second manifold 308 to the first manifold 306. In one embodiment, the first section of heat exchange tubes 304A is parallel to the second section of heat exchange tubes 304B, so that the refrigerant flows in the U-flow.

The heat exchange core 302 further comprises a baffle 310 to guide the coolant, entering from the first inlet 104A, across the heat exchange tubes 304. In one embodiment, the baffle 310 is provided between the first section of heat exchange tubes 304A and the second section of heat exchange tubes 304B. In one embodiment, the heat exchange core 302 includes the plurality of heat exchange tubes 304 stacked with a plurality of heat exchange fins in an alternate fashion. In another embodiment, the heat exchange tubes 304 can be flat tubes. Further, the connector block 202 enables introduction/reception of the refrigerant to/from the heat exchange core 302. The refrigerant flow and the coolant flow in and around the heat exchange core 302 are in heat-exchange configuration to enable heat exchange between the refrigerant and the coolant.

Figure 3:
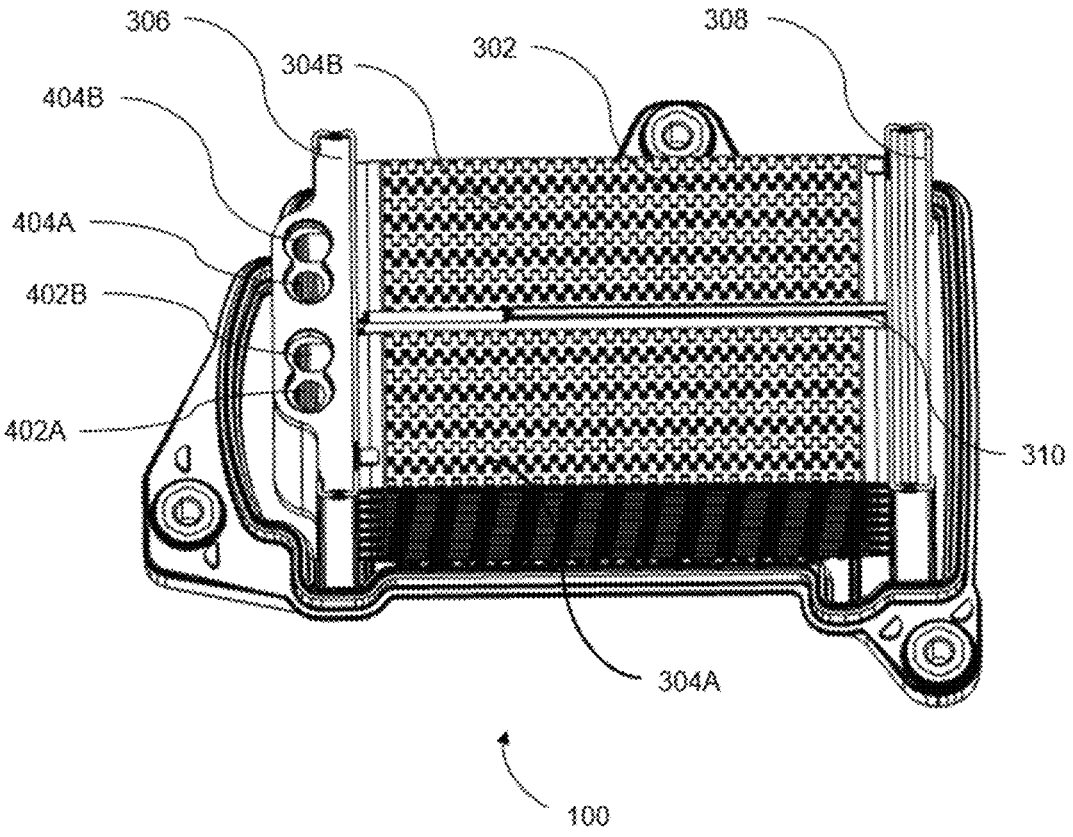
FIG. 3 illustrates a perspective view of a heat exchange core without a connector block shown in FIG. 2.
Figure 4:
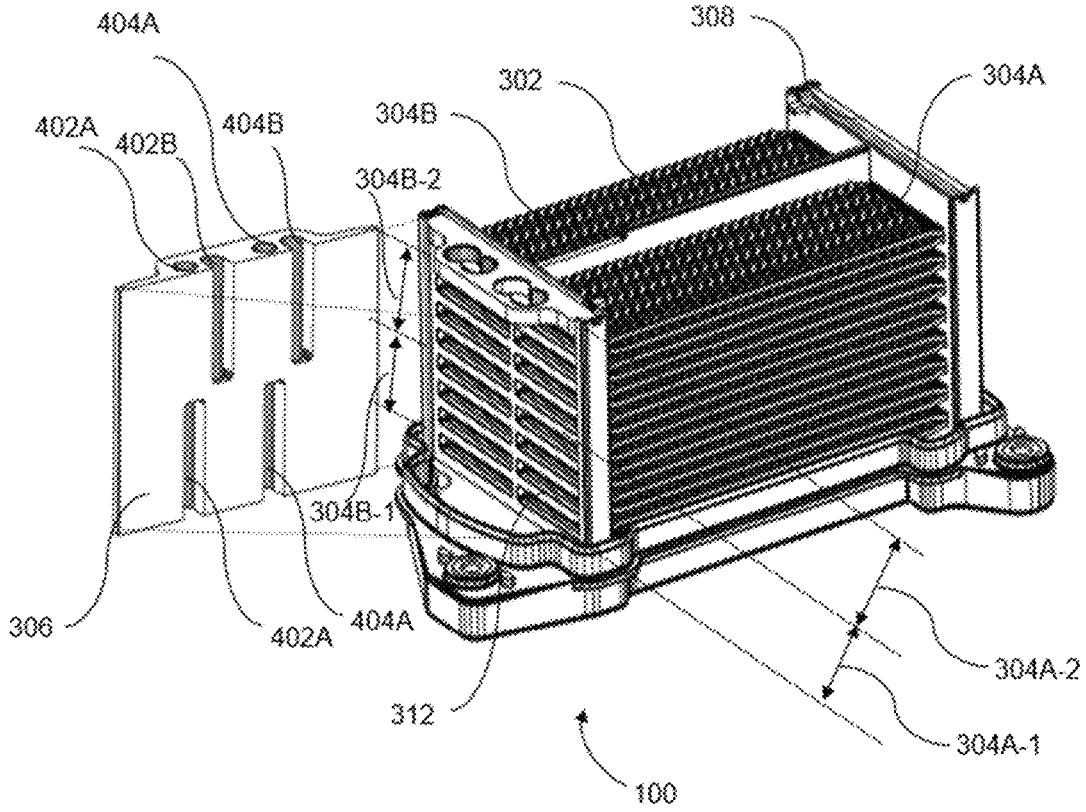
FIG. 4 illustrates an exploded view of a first manifold and the heat exchange core of the heat exchanger of FIG. 2.

FIGS. 3 and 4 illustrates perspective views of the heat exchanger 100 of FIG. 2. In this example, FIG. 3 is a perspective view of the heat exchanger 100 depicting heat exchange core 302 without the connector block 102, and FIG. 4 is an exploded view of the first manifold 306 and the heat exchange core 302 of FIG. 3. According to one aspect of the present invention, the first manifold 306 includes a first channel 402A and a second channel 402B through which the refrigerant ingresses to the first section of heat exchange tubes 304A. In one embodiment, the second channel 402B can be parallel to the first channel 402A. Further, the first channel 402A and the second channel 402B are fluidically isolated from each other, thereby preventing the refrigerant flow between the first channel 402A and the second channel 402B. The first channel 402A is connected with a first set of heat exchange tubes 304A-1 amongst the first section of heat exchange tubes 304A, and the second channel 402B is connected with a second set of heat exchange tubes 304A-2 amongst the first section of heat exchange tubes 304A. Generally, the first channel 402A and the second channel of the first manifold 306 introduce the refrigerant to the first section of heat exchange tubes 304A. Particularly, the first channel 402A is adapted to introduce the refrigerant to the first set of heat exchange tubes 304A-1 amongst the first section of heat exchange tubes 304A and the second channel 402B is adapted to introduce the refrigerant to the second set of heat exchange tubes 304A-2 amongst the first section of heat exchange tubes 304A.

In one embodiment, the first set of heat exchange tubes 304A-1 can be one half of heat exchange tubes among the first section of heat exchange tubes 304A, and the second set of heat exchange tubes 304A-2 can be another half of heat exchange tubes among the first section of heat exchange tubes 304A. The first channel 402A and the second channel 402B are further connected to the inlet 204A to introduce the first set of heat exchange tubes 304A-1 and the second set of heat exchange tubes 304A-2. Particularly, the first channel 402A is directly connected to the inlet 204A and the first set of heat exchange tubes 304A-1, while the second channel 402B is directly connected to the inlet 204A and the second set of heat exchange tubes 304A-2.

Figure 5:
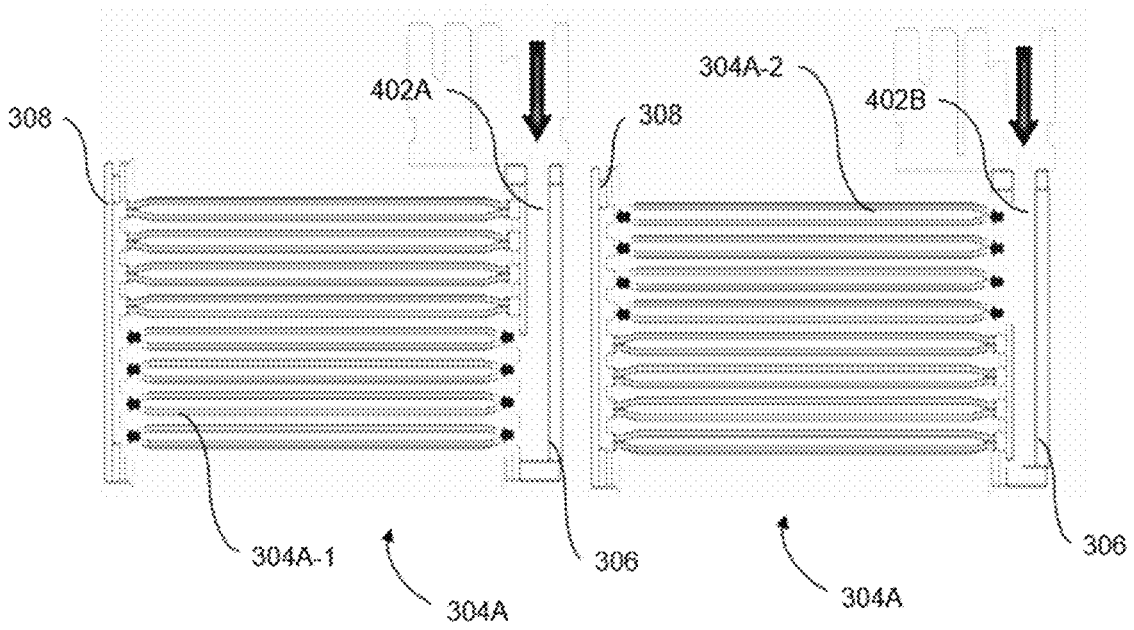
FIG. 5 illustrates cross sectional views of the heat exchange core of FIG. 3, when cut at first and second channels.

FIG. 5 illustrates cross sectional views of the heat exchange core 302 of FIG. 3, when cut at the first and second channels 402A, 402B. The first channel 402A is connected with a lower half of heat exchange tubes 304A-1 among the first section of heat exchange tubes 304A, and the second channel 402B is connected with an upper half of heat exchange tubes 304A-2 among the first section of heat exchange tubes 304A. In this embodiment, the lower half of the heat exchange tubes 304A-1 is the first set of heat exchange tubes and the upper half of the heat exchange tubes 302A-2 is the second set of heat exchange tubes.

In one embodiment, the first set of heat exchange tubes 304A-1 can be even numbered heat exchange tubes amongst the first section of heat exchange tubes 304A, and the second set of heat exchange tubes 304A-2 can be odd numbered heat exchange tubes amongst the first section of heat exchange tubes 304A. Further, the first set of heat exchange tubes 304A-1 and the second set of heat exchange tubes 304A-2 can include any number and/or order of heat exchange tubes among the first section of heat exchange tubes 304A. In another embodiment, the first set of heat exchange tubes 304A-1 and the second set of heat exchange tubes 304A-2 can include one or more number of heat exchange tubes among the first section of heat exchange tubes 304A as common. In other words, no of heat exchange tubes in the first set of heat exchange tubes 304A-1 and the second set of heat exchange tubes 302A-2 are different in number.

Again referring to FIGS. 3 and 4, the first manifold 306, according to another aspect, further includes third and fourth channels 404A, 404B through which the refrigerant egresses from the second section of heat exchange tubes 304B. The second channel 404A is connected with a third set of heat exchange tubes 304B-1 amongst the second section of heat exchange tubes 304B, and the fourth channel 404B is connected with a fourth set of heat exchange tubes 304B-2 amongst the second section of heat exchange tubes 304B. In one embodiment, the third set of heat exchange tubes 304B-1 can be one half of heat exchange tubes among the second section of heat exchange tubes 304B, and the fourth set of heat exchange tubes 304B-2 can be another half of heat exchange tubes among the second section of heat exchange tubes 304B. In another embodiment, the third set of heat exchange tubes 304B-1 can be even numbered heat exchange tubes among the second section of heat exchange tubes 304B, and the fourth set of heat exchange tubes 304B-2 can be odd numbered heat exchange tubes among the second section of heat exchange tubes 304B. The heat exchanger core 302 further comprises a header plate 312 interposed between the first manifold 306 and the heat exchange tubes 304. Further, the second manifold 308 includes a partition to fluidically connect the first set of heat exchange tubes 304A-1 with the third set of heat exchange tubes 304B-1 and the second set of heat exchange tubes 304A-2 with the fourth set of heat exchange tubes 304B-2.

Figure 6:
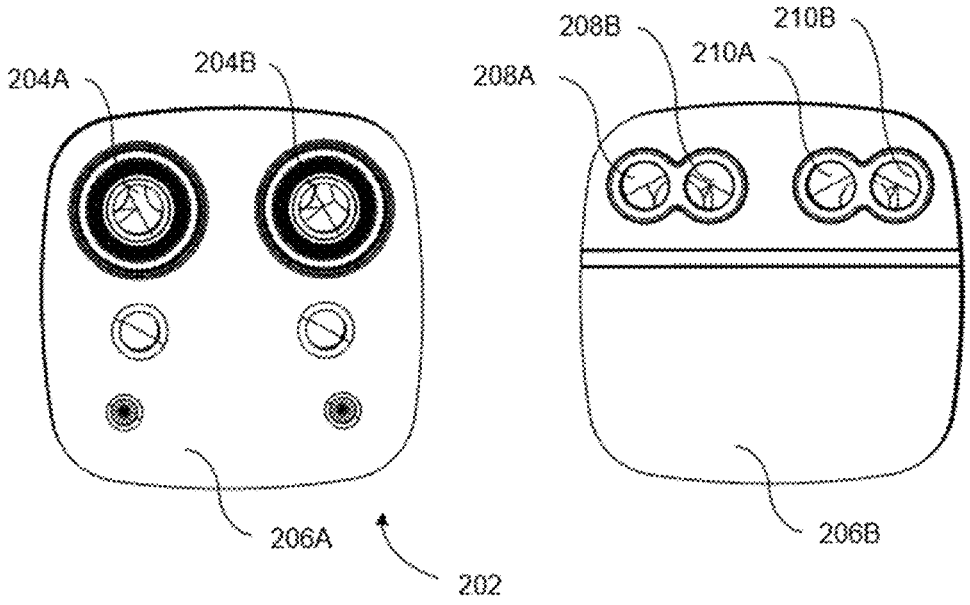
FIG. 6 illustrates different views of the connector block 202 of FIG. 2.
Figure 7:
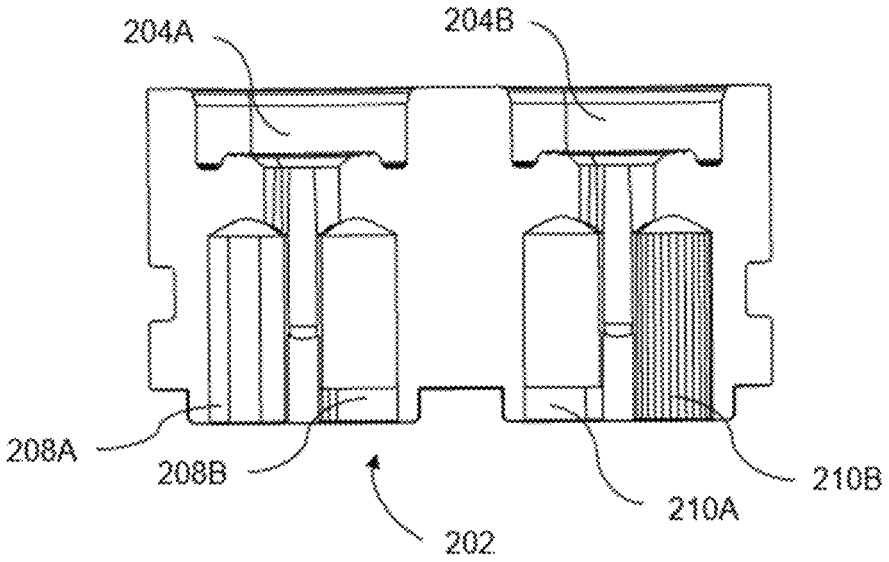
FIG. 7 illustrates a cross sectional view of the connector block shown in FIG. 2.

FIGS. 6 and 7 illustrate different views and a cross sectional view of the connector block 202 of FIG. 2 respectively. The connector block 202 includes the second inlet and outlet 204A, 204B provided at a first side 206A of the connector block 202. Further, the second inlet 204A is of a single opening formed on the first side 206A of the connector block 202. The second inlet 204A splits into first and second passages 208A, 208B at a second side 206B of the connector block 202. In one embodiment, the second side 206B of the connector block 202 is opposite to the first side 206A of the connector block 202. In one embodiment, the cross sectional area of the second inlet 204A is greater than the cross sectional areas of the first and second passages 208A, 208B. Further, the second passage 208B is parallel to the first passages 208A. Similarly, the second outlet 204B is divided into third and fourth passages 210A, 210B provided at the second side 206B of the connector block 202. Further, the third passage 210A and the fourth passage 210B are parallel with respect to each other.

Figure 8:
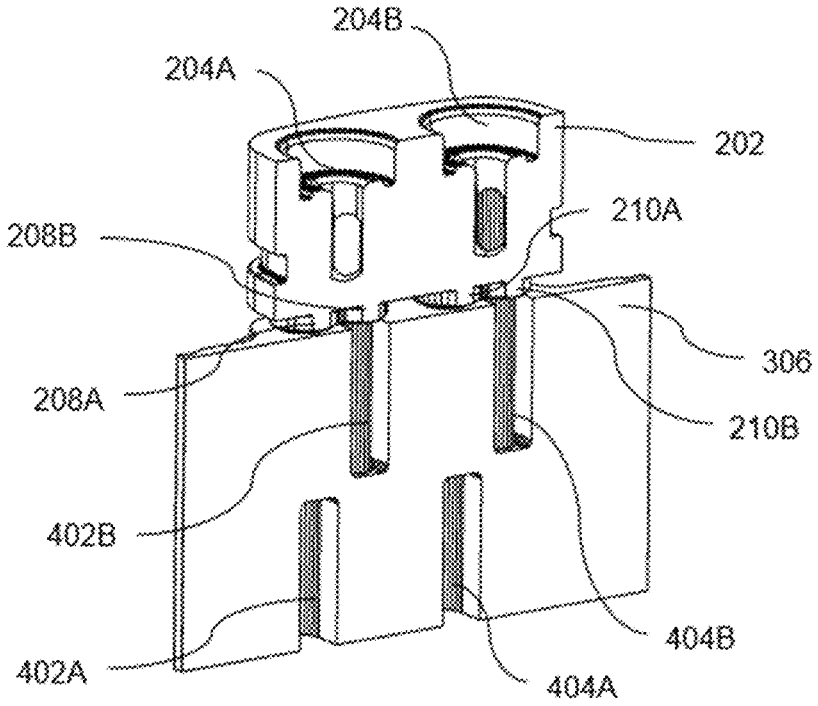
FIG. 8 illustrates a cross sectional view of the connector block along with the first manifold shown in FIG. 2.

FIG. 8 illustrates a cross sectional view of the connector block 202 along with the first manifold 306 shown in the FIG. 2. The first and second passages 208A, 208B of the connector block 202 connect with the first and second channels 402A, 402B of the first manifold 306 respectively, thereby guiding the refrigerant from the second external fluid circuit to the first section of heat exchange tubes 304A. Therefore, the refrigerant uniformly flows through the first set of heat exchange tubes 304A-1 and the second set of heat exchange tubes 304A-2 among the first section of heat exchange tubes 304A, without increasing the pressure drop. Further, the third and fourth passages 210A, 210B of the connector block 202 connect with the third and fourth channels 404A, 404B of the first manifold respectively, thereby guiding the refrigerant from the second section of heat exchange tubes 304B to the second external fluid circuit. Consequently, the refrigerant uniformly flows through the third set of heat exchange tubes 304B-1 and the fourth set of heat exchange tubes 304B-2 among the second section of heat exchange tubes 304B, without increasing the pressure drop. As the refrigerant uniformly distributed across the heat exchange tubes 304, thermal efficiency of the heat exchanger 100 is increased. Further, thermal shock can be avoid by the above configuration, thereby increasing service life of the heat exchanger.

What is claimed is:

1. A heat exchanger for a heat exchange fluid, comprising:

a connector block including an inlet being a single opening formed on a first side of the connector block and splitting into a first passage and a second passage at a second side of the connector block, and an outlet being a single opening formed on the first side of the connector block and divided into a third passage and a fourth passage at the second side of the connector block:

a first manifold including at least one first channel and at least one second channel;

a second manifold spaced apart from the first manifold; and a plurality of heat exchange tubes fluidically connecting the first manifold and the second manifold, wherein the plurality of heat exchange tubes is divided into a first section of tubes and a second section of tubes, wherein the at least one first channel is directly connected to the first passage of the inlet and a first set of tubes amongst the first section of tubes, while the at least one second channel is directly connected to the second passage of the inlet and a second set of tubes amongst the first section of tubes, wherein the first manifold further includes a third channel directly connected to the third passage of the outlet and a third set of tubes amongst the second section of tubes and a fourth channel directly connected to the fourth passage of the outlet and a fourth set of tubes amongst the second section of tubes, and wherein the first manifold is adapted to prevent the heat exchange fluid from travelling between the at least one first channel and the at least one second channel within the first manifold.

2. The heat exchanger as claimed in claim 1, wherein the first section of tubes and the second section of tubes are arranged in at least two parallel stacks to provide at least one U-turn for the heat exchange fluid.

3. The heat exchanger as claimed in claim 1, wherein the first section of tubes fluidically connects with the second section of tubes through the second manifold.

4. The heat exchanger as claimed in claim 1, wherein the first set of tubes fluidically connects with the third set of tubes through the second manifold, and the second set of tubes fluidically connects with the fourth set of tubes through the second manifold.

5. The heat exchanger as claimed in claim 1, wherein the first passage and the second passage of the connector block are fluidically connected to the at least one first channel and the at least one second channel of the first manifold respectively.

6. The heat exchanger as claimed in claim 1, wherein the third passage and the fourth passage of the connector block are fluidically connected to the third channel and the fourth channel of the first manifold respectively.

* * * * *